United States Patent [19]

Osborne

[11] 4,065,399

[45] Dec. 27, 1977

[54] PROCESS FOR CONTROLLING A BONDING GAS SYSTEM

[75] Inventor: Franklin T. Osborne, Gulf Breeze, Fla.

[73] Assignee: Monsanto Company, St. Louis, Mo.

[21] Appl. No.: 724,038

[22] Filed: Sept. 17, 1976

[51] Int. Cl.[2] ..... C09K 3/00

[52] U.S. Cl. ..... 252/182; 156/181; 156/290; 156/306; 252/372; 423/240; 423/481

[58] Field of Search ..... 423/240, 481; 55/71, 55/53; 252/182, 372; 156/181, 290, 306

[56] References Cited

U.S. PATENT DOCUMENTS

| | | | |
|---|---|---|---|
| 1,906,467 | 5/1933 | Heath | 423/481 |
| 3,174,873 | 3/1965 | Callow et al. | 252/372 |
| 3,542,615 | 11/1970 | Dobo et al. | 156/181 |
| 3,676,244 | 7/1972 | Kim | 156/181 |
| 3,705,068 | 12/1972 | Dobo et al. | 156/181 |

*Primary Examiner*—Benjamin R. Padgett

*Assistant Examiner*—Deborah L. Kyle

*Attorney, Agent, or Firm*—Donald J. Fitzpatrick

[57] ABSTRACT

A process for controlling a bonding gas system is disclosed. The process controls temperature and composition of an activating gas used for bonding a nonwoven web of continuous nylon filaments and for supplying the gas to a gas box at a temperature just above its dew-point. A monitored concentration of liquid HCl, maintained at a predetermined temperature, is supplied to a stripper column; an HCl-water-air mixture which contains a low volume percent of HCl is circulated through the stripper column so that the mixture evaporates a portion of the liquid HCl wherein the volume percent of HCl in the mixture is increased thereby forming a bonding gas having the desired HCl concentration; the temperature of the gas leaving the stripper column is controlled so that the HCl concentration of the gas is just above its dew-point and then the gas is fed into a gas box.

5 Claims, 1 Drawing Figure

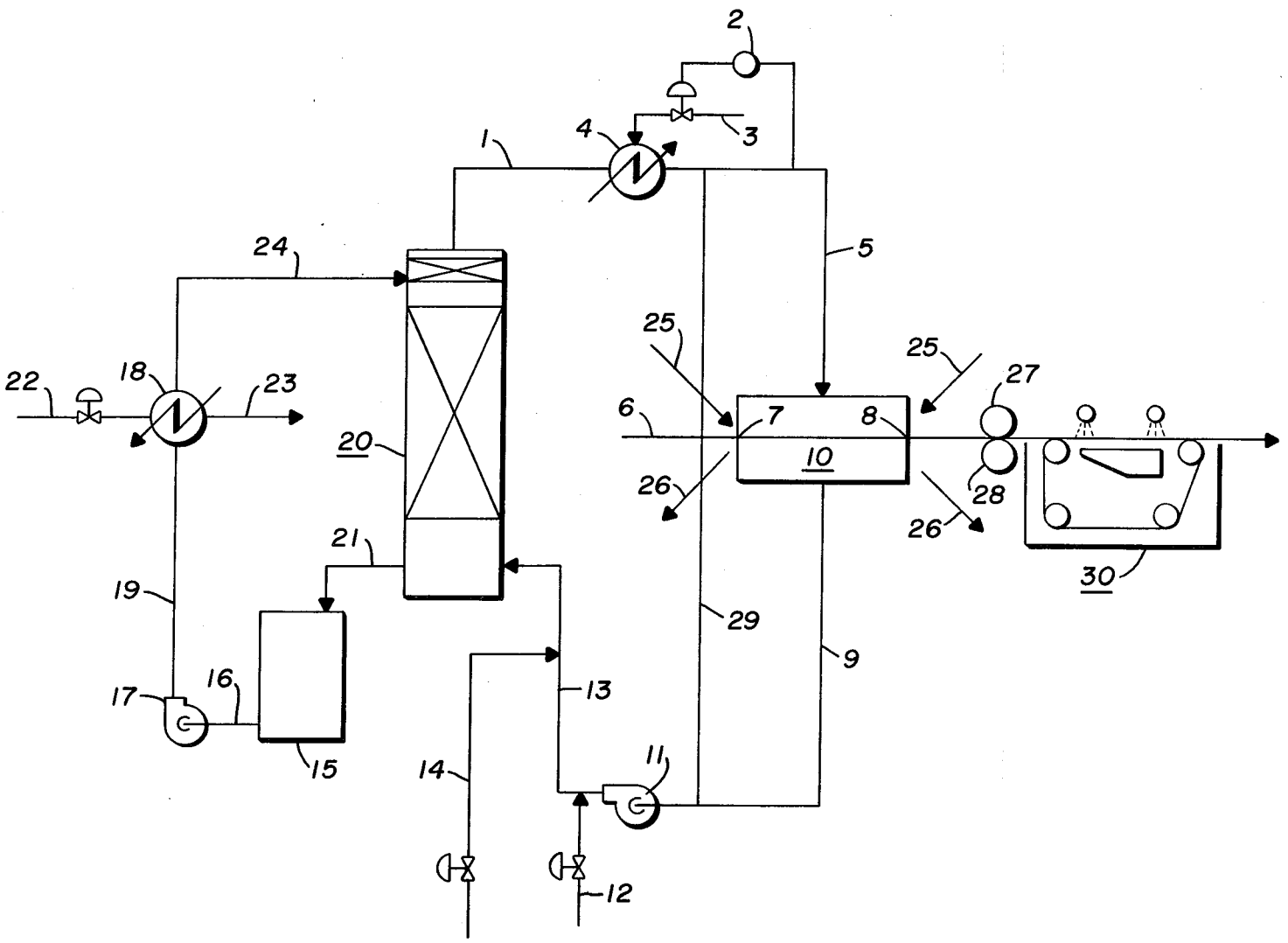
1
2
3
4
5
6
7
8
9
10
11
12
13
14
15
16
17
18
19
20
21
22
23
24
25
26
27
28
29
30

PROCESS FOR CONTROLLING A BONDING GAS SYSTEM

BACKGROUND OF THE INVENTION

1. Field of the Invention

This invention relates to a process for controlling a bonding gas system and more specifically for controlling the temperature and composition of an activating gas for bonding nonwoven webs of nylon filaments.

2. Description of the Prior Art

Nonwoven webs comprised of a plurality of substantially continuously and randomly deposited filaments of a thermoplastic polymer are well known. There are many different processes for preparing nonwoven webs and, as initially prepared, such webs lack adequate strength and other desirable physical properties necessary for commercial utility. It is therefore conventional practice to strengthen the webs by bonding the filaments together.

Processes for forming and bonding nonwoven webs in a continuous manner are disclosed in U.S. Pat. No. 3,542,615 for "Process for Producing a Nylon Nonwoven Fabric," U.S. Pat. No. 3,676,244 for "Process for Forming High Strength Spun Bonded Fabric by Autogneous Bonding of Filaments," and U.S. Pat. No. 3,705,068 for "Process and Apparatus for Producing Nonwoven Fabrics." In these patents bonding is accomplished by advancing a web through a chamber filled with an activating gas wherein residence time is sufficient to permit absorption of gas into the filaments. The preferred activating gas is hydrogen chloride. These patents disclose preparing a web of nonwoven continuous filaments spun from molten polyamide, pneumatically attenuating the filaments and then depositing them on a conveyor belt to form a coherent, uniform web. The web is then passed into a chamber where it is subjected to a hydrogen chloride atmosphere. Bonding occurs autogeneously at the filament cross-over points. After sufficient residence time in the chamber or gas box to permit surface absorption of the activating gas the web is then compacted, washed and collected.

For an efficient and economical process, control of the activating gas entering the gas box is absolutely essential. To insure adequate bonding at the filament cross-over points, the concentration and temperature of the gas must be carefully controlled and monitored. An economical process is one that is characterized by a high product yield. High yields are attained by producing a uniform product having minimal defects. Satisfactory control of the activating gas is therefore critical to an economical, high yield process. For example, the surface quality of nonwoven webs can be damaged thus lowering yield by the activating gas when the acid concentration is not maintained within carefully prescribed limits.

The activating gas employed in this bonding system consists of three components, air, HCl and water. Bonding is accomplished by contacting the web with a mixture of hydrogen chloride, water and air for a time sufficient to allow HCl and water to be absorbed by the nylon filaments. The rate of absorption of HCl and water is dependent upon several parameters including the initial water content of the filaments, the HCl and $H_2O$ concentrations in the bonding gas and the bonding gas temperature. For this reason, it is necessary to have precise control over the gas concentration and temperature in order to regulate the degree of bonding achieved. Two systems have been used in the processes disclosed in the heretofore referenced patents for supplying the activating gas. Each system has had varying degrees of success and each is characterized by operating disadvantages peculiar to that specific system.

One system is a single pass one that furnishes an air stream of sufficient volume to provide the required air flow. The air stream is conditioned through an air conditioning train to the desired temperature and moisture content. Gaseous HCl is then metered into this conditioned air stream thereby providing the desired acid concentration. The gas is passed once through the gas box. After contacting the web, the exiting stream is scrubbed with water to remove the unconsumed HCl, demisted and discharged into the atmosphere.

A second system is a recirculating one wherein the activating gas consists of two-thirds recycled gas and one-third make-up air. A portion of the HCl-water-air mixture that was discharged from the gas box is recycled and the unused portion is scrubbed with water, demisted and discarded. The balance of the activating gas is provided by passing an air stream through a conditioning train and then mixing it with the recycled portion. All of the gas cannot be recycled because constant gas temperature necessitates removing the heat of compression supplied by a recirculating blower. This is accomplished by regulating make-up air temperature below the return gas temperature so that the resulting gas mixture is maintained at the correct temperature. It is not possible to use a normal heat exchanger to remove the heat of compression because the HCl and water tend to condense.

Both of these systems are characterized by the disadvantages of (1) discarding relatively large quantities of HCl, this is both expensive and it also poses an ecology problem, and (2) requiring a precisely controlled, low moisture content make-up air stream. Furthermore, the recirculating system is inherently unstable because ambient air containing an uncontrolled amount of water at a fluctuating temperature is constantly being drawn into the gas box during recycling.

SUMMARY OF THE INVENTION

The process of this invention provides a stable gas activated bonding system that offers control of bonding gas temperature and composition. Furthermore, the bonding gas is constantly supplied to the gas box at a temperature just above its dew-point. This insures a more efficient and faster process because a more rapid rate of bonding takes place. The bonding gas is saturated with the condensable component, HCl, and the rate of bonding is maximized. This process is further characterized by a recycling of all HCl gas which is not consumed during bonding in the gas box. This complete utilization lowers product cost and is ecologically favorable. Less capital expense is required to neutralize any unconsumed acid.

The advantages of this invention can be summarized as follows: (1) a stable process due to precise control of temperature and composition of the bonding gas; (2) rapid rate of bonding since gas is saturated with hydrochloric acid; (3) economical and pollution free process since all HCl is consumed.

The process of this invention comprises the steps of: (a) supplying a monitored concentration of liquid HCl maintained at a predetermined temperature to a stripper column; circulating an HCl-water-air mixture which contains a low volume percent of HCl through said stripper column so that said mixture evaporates a portion of the liquid HCl, wherein the volume percent of HCl in said mixture is increased, thereby forming a bonding gas having the desired HCl concentration; controlling the temperature of said gas as it is drawn off the column so that said gas has an HCl concentration just above its dew-point and feeding the gas to a gas box.

It is therefore an object of this invention to provide a new process for controlling the temperature and composition of a bonding gas. A further object of this invention is to provide a process for supplying a bonding gas at a temperature just above its dew-point.

A still further object of this invention is to provide a process wherein bonding gas which is not consumed during bonding is recycled.

BRIEF DESCRIPTION OF THE DRAWING

FIG. 1 is a schematic representation of a system provided by this invention.

DESCRIPTION OF THE PREFERRED EMBODIMENT

Referring to FIG. 1 bonding gas is supplied to a gas box 10 from a stripping column 20. This gas is obtained by the stripping of liquid HCl and water that is introduced into the top of the column by a counter-current flow of a lean HCl-water-air mixture that is introduced into the lower portion of the column.

In a typical operation of the system of this invention a gas for bonding nonwoven fabric webs is withdrawn from the top of a stripping column 20 via conduit 1. The temperature of the gas is controlled by a temperature regulating means 2. This regulating means can inject steam via conduit 3 into a heat exchanger 4 positioned in conduit 1 when necessary to elevate the bonding gas temperature. As used herein bonding gas is considered to mean a three component gas system consisting of water vapor, gaseous HCl and air. The terms "bonding gas" and "activating gas" are equivalent for purposes of this specification and may be used interchangeably.

Bonding gas at a predetermined temperature and composition enters gas box 10 via conduit 5. The temperature and composition of the gas is maintained within a broad range of 21°–52° C, 0.1–10% HCl, 0.2–2% $H_2O$; a more narrow range of 21°–38° C, 0.1–1% HCl, 1–2% $H_2O$ and with more preferred conditions of 32° C and 0.44% HCl, 1.31% $H_2O$. A nonwoven web 6 of continuous nylon filaments enters the gas box at 7 and is contacted by the activating gas and absorbs a quantity of the gas as it resides within the box. When the web emerges from the box at 8 its weight has increased as a result of absorbing a quantity of water and acid. As used herein, all gas concentrations are expressed as mole or volume percent.

The unconsumed bonding gas is now rich in air and partially depleted in HCl and water, as this lean gas leaves the gas box via conduit 9 it enters a gas recirculating blower 11. A supply of gaseous HCl is added to the lean gas mixture through conduit 12 from a supply source not shown. This make-up acid supplies the lean gas mixture with that quantity of acid absorbed by the web. The composition of the lean gas is about 0.41% HCl and the acid make-up brings the composition up to about 0.44% HCl. As shown in FIG. 1 steam is depicted as being injected into conduit 13 via conduit 14. The purpose of adding steam is to replace the water that is absorbed by the web 6. Steam is used because the volume of water required is small and in order for accurate control it has to be metered in the gas phase. The lean gas containing the added make-up acid and water is then introduced via conduit 13 to a lower portion of the stripper column 20.

A reservoir 15 containing liquid HCl supplies acid to the upper portion of the stripper column. Acid passes via conduit 16 to a circulating pump 17 on to a heat exchanger 18 via conduit 19.

The liquid acid enters heat exchanger 17 wherein the temperature is regulated prior to entry of the liquid into the stripper column. Temperature regulation is necessary because heat is added to the bonding gas as it cycles through the system shown in FIG. 1 and this heat must be removed from the system. Heat exchanger 4 is one source of additional heat. Due to adiabatic heat of compression, heat is also added as the bonding gas passes through recirculating blower 11. As the warm bonding gas ascends in the stripper column it contacts the cooler descending liquid HCl and water. There is a direct liquid-gas interchange as the heat contained by the bonding gas is transferred to the liquid and the liquid HCl and water temperature is increased and with a corresponding reduction in bonding gas temperature. When the liquid passes into reservoir 15 via conduit 21 from the bottom of the stripper column, it is at a higher temperature than when it entered the stripper column. The liquid temperature must be reduced and this is accomplished by temperature control water that enters via conduit 22 and is subsequently discharged via conduit 23.

A monitored concentration of liquid HCl maintained at a predetermined temperature enters the upper portion of the stripper column via conduit 24. The concentration of the acid is maintained in the range of 20–30 wt.% and the temperature range is 21°–52° C. The acid and water drips down the column and contacts trays, plates, packing and other devices contained within the column. The water vapor, gaseous HCl and air mixture that contains a low volume percent of HCl is introduced at the bottom of the column and circulates upwardly thereby removing gaseous HCl and water vapor from the descending mixture of acid and water so that the volume percent of HCl in the mixture in increased. The gas that is drawn off via conduit 1 is saturated and is at its dew point. The system of this invention therefore supplies a water vapor, gaseous HCl and air bonding gas mixture by recirculating the total bonding gas stream through a packed column that is continuously wetted by a counter-current flow of concentrated aqueous hydrochloric acid.

FIG. 1 also shows a circulating stream of air, depicted as numericals 25 and 26 that function as end-seals to isolate the gas box from the surrounding environment. These streams prevent bonding gas from escaping and atmospheric air surrounding the gas box from entering and effecting the bonding conditions within the gas box. After the web is exposed to the bonding gas, it is pressed and compacted between a pair of rolls 27, and 28 and then enters a wash stand 30. Conventional equipment such as pull rolls and a pull stand move the web from the gas box, through the pressing rolls, wash stand and onto succeeding processing stations. Conduit 29 functions as a bypass means whenever bonding gas is not to be supplied to the gas box, for instance during stoppages or equipment malfunctions.

One of the distinct advantages of this invention over the prior art methods for supplying bonding gas resides in simplified controls. By using the system of this invention and equilibrating bonding gas and liquid hydrochloric acid insures that the gas drawn off the column is very near the dew point. Control of bonding gas temperature at this point is essential. The speed and basis weight of web 6 influence the absorption potential of the bonding gas and can vary over wide ranges. To compensate for various web conditions the dew point of the gas must be capable of regulation. This can be accomplished by temperature regulating means 2. As those skilled in the art will recognize, the annexed drawing is schematic in that fluid transfer devices, instrumentation, etc., are not generally therein depicted. However, when cooling water and steam are employed, temperature devices are also used. It is essential to control the HCl make-up flow rate from conduit 12 in order to maintain a constant stripper column liquid HCl concentration. Instrumentation for continuous measurement of the liquid HCl concentration can include conductivity measurement and specific gravity indicating devices. The column temperature will also be kept constant by heat exchanger 18.

The following examples are presented to further illustrate this invention but are not intended as limiting the scope thereof.

EXAMPLE I

This example is a computed material balance illustrating the process of this invention for 108.86 kg/hr of fabric having a basis weight of 10.17 gms/m² and traveling at a line speed of 117 m/min. Temperatures, pressures, flow rates and stream compositions are given in Table I which follows. The reference numerals appearing in parentheses below the stream identifications are those used in FIG. 1 and are provided to facilitate a cross-reference between this example and the drawing.

TABLE I

| Stream Component | Lean Gas (CHl-$H_2O$) to Stripper (13) | Bonding Gas to Gas Box (5) | Unconsumed Bonding Gas (9) | Make-Up Acid Addition (12) | Make-Up Water Addition (14) | Circulating Liquid to Heat Exchanger (19) | Circulating Liquid to Stripper (24) |
|---|---|---|---|---|---|---|---|
| HCl, Kg/hr | 57.79 | 62.37 | 57.79 | 4.58 | — | 10,204 | 10,204 |
| $H_2O$, Kg/hr | 145.33 | 150.63 | 145.33 | — | 5.32 | 30,534 | 30,534 |
| Air, Kg/hr | 10,648 | 10,648 | 10,648 | — | — | — | — |
| Nylon, Kg/hr | — | — | — | — | — | — | — |
| Total, Kg/hr | 10,851.50 | 10,861.39 | 10,851.50 | 4.50 | 11.7 | 40,738.50 | 40,738.50 |
| Normal, liters/min. | (21,319) | (21,338) | (21,592) | (1.85) | (7.23) | 594 | 594 |
| Maximum, liters/min. | (22,712) | (22,712) | (22,712) | (9.08) | (31.04) | 757 | 757 |
| Pressure, Kg/cm² | (+5.16) | (0.0) | (−2.76) | 42.44 | 21.23 | 18.39 | 18.39 |
| Density, Kg/m³ | 1.13 | 1.13 | 1.12 | 5.54 | 1.64 | 1,140.62 | 1,140.62 |
| Temperature, ° C | 35.89 | 31.53 | 32.22 | 29.44 | 134.5 | 31.67 | 31.53 |
| State | Gas | Gas | Gas | Gas | Vapor | Liquid | Liquid |

| Stream Component | Ungassed Web (6) | Gassed Web (8) | Air Circulating Thru Gas Box (25) | HCl-$H_2O$ Pick-up by Circulating Air (26) | Temperature Control Water-in (22) | Temperature Control Water-out (23) | Steam for Temperature Regulation (3) |
|---|---|---|---|---|---|---|---|
| HCl, Kg/hr | — | 3.81 | — | .77 | — | — | — |
| $H_2O$, Kg/hr | 2.18 | 5.53 | — | 1.95 | 1,568.5 | 1,568.5 | 3.76 (Normal) 67.77 (Max.) |
| Air, Kg/hr | — | — | 140.56 | 140.56 | — | — | — |
| Nylon, Kg/hr | 108.86 | 108.86 | — | — | — | — | — |
| Total, Kg/hr | 111.03 | 118.21 | 140.57 | 143.29 | 1,568.5 | 1,568.5 | 3.76 (Normal) 67.77 (Maximum) |
| Normal, liters/min | — | — | (276) | (283.9) | 26.12 | 26.12 | (3.63) |
| Maximum, liters/min | — | — | (276) | (283.9) | 117 | 117 | (64.35) |
| Pressure, Kg/cm² | — | — | (0.0) | (0.0) | — | — | 35.37 |
| Density, Kg/m³ | 1140.62 | 1140.62 | 1.14 | 1.12 | 999.65 | 999.65 | 2.29 |
| Temperature, ° C | 25.56 | 32.22 | 26.67 | 32.22 | 7.22 | 12.78 | 147.78 |
| State | Solid | Solid | Gas | Gas | Liquid | Liquid | Vapor |

This example shows that approximately 9.9% of the gaseous HCl and water vapor components of the bonding gas mixture are absorbed by web 6. The unconsumed portion is recycled through the system in the manner of this invention.

EXAMPLES II and III

These examples are presented to illustrate the process of this invention employed in a typical production mode. An arrangement as disclosed in U.S. Pat. Nos. 3,542,615 and 3,676,244 was operated at a line speed of about 41.1 m/min producing a web having a basis weight of 25.43 gm/m² and at a rate of about 102.05 Kg/hr. The stream components shown in the following tables were measured in a manner well known to those skilled in the art. The reference numerals appearing in parentheses below the stream identifications are those used in FIG. 1 and are provided to facilitate a cross-reference between these examples and the drawing.

TABLE II

| Stream Component | Bonding Gas Drawn Off Stripper (1) | Bonding Gas To Gas Box (5) | Unconsumed Bonding Gas (9) | Ungassed Web (6) | Gassed Web (8) | Reservoir (15) | Circulating Liquid To Heat Exchanger (19) |
|---|---|---|---|---|---|---|---|
| HCl, Kg/hr. | — | 14.39 | 12.70 | — | 1.69 | — | — |
| $H_2O$, Kg/hr. | — | — | — | 1.00 | 3.42 | — | — |
| Nylon, Kg/hr. | — | — | — | 102.05 | 102.05 | — | — |
| Total, Kg/hr. | 15,565 | 3,913 | — | 103.05 | 107.16 | — | — |
| Water flow, liters/min | — | — | — | — | — | — | 530.0 |
| Temperature, ° C | 29.7 | 32.2 | — | — | — | — | 30.6 |
| Weight %, HCl | — | — | — | — | — | 24.0 | — |
| Weight %, $H_2O$ | — | — | — | — | — | 76.0 | — |

TABLE III

| Stream Component | Bonding Gas Drawn Off Stripper (1) | Bonding Gas To Gas Box (5) | Unconsumed Bonding Gas (9) | Ungassed Web (6) | Gassed Web (8) | Reservoir (15) | Circulating Liquid To Heat Exchanger (19) |
|---|---|---|---|---|---|---|---|
| HCl, Kg/hr | — | 15.46 | 12.27 | — | 3.19 | — | — |
| $H_2O$, Kg/hr | — | — | — | 1.63 | 7.10 | — | — |
| Nylon, Kg/hr | — | — | — | 102.05 | 102.05 | — | — |
| Total, Kg/hr | 15,763 | 4,045 | — | 103.68 | 112.34 | — | — |
| Water flow, liters/min | — | — | — | — | — | — | 530.0 |
| Temperature, ° C | 29.7 | 32.2 | — | — | — | — | 30.7 |
| Weight %, HCl | — | — | — | — | — | 24.0 | — |
| Weight %, $H_2O$ | — | — | — | — | — | 76.0 | — |

The data shown in Tables II and III was collected on two different days and shows that the temperature of the bonding gas drawn off the stripper column and passed into the gas box remained constant. Furthermore the process of this invention recycled back through the system shown in FIG. 1 substantially all of the unconsumed bonding gas mixture.

Having described in considerable detail the process of this invention, it is to be understood that modifications and variations may be resorted to without departing from the spirit and scope of the invention, as those skilled in the art will readily understand. Such modifications and variations are considered to be within the spirit and scope of the invention as defined in the appended claims.

I claim:

1. A process for controlling the temperature and composition of a bonding gas used for bonding a nonwoven web of continuous nylon filaments and for supplying said gas to a gas box at a temperature just above its dew-point, comprising the steps;

supplying a monitored concentration of liquid HCl, maintained at a predetermined temperature to a stripper column;

circulating an HCl-water-air mixture which contains a low volume percent of HCl through said stripper column so that said mixture evaporates a portion of the liquid HCl wherein the volume percent of HCl in said mixture is increased thereby forming a bonding gas having the desired HCl concentration;

controlling the temperature of said gas as it is drawn off the column so that said gas has an HCl concentration just above its dew-point; and feeding said gas to a gas box.

2. The process of claim 1 wherein the composition, in volume percent, of said bonding gas is from about 0.1% to about 10% HCl, from about 0.2% to about 2% water, balance air.

3. The process of claim 2 wherein the temperature of said bonding gas is in the range of 21° to 52° C.

4. The process of claim 1 wherein the composition, in volume percent, of said bonding gas is from about 0.1% to about 1% HCl, from about 1% to about 2% water, balance air.

5. The process of claim 4 wherein the temperature of said bonding gas is in the range of 21° to 38° C.

* * * * *